US007252413B2

(12) United States Patent
Orfield et al.

(10) Patent No.: US 7,252,413 B2
(45) **Date of Patent: *Aug. 7, 2007**

(54) LIGHT FIXTURE, REFLECTOR HOUSING, AND FACILITY THAT INCLUDES A PLURALITY OF LIGHT FIXTURES

(75) Inventors: Steven J. Orfield, Minneapolis, MN (US); Michael R. Role, Roseville, MN (US)

(73) Assignee: Orfield Laboratories, Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/931,264

(22) Filed: Aug. 31, 2004

(65) Prior Publication Data

US 2005/0231959 A1 Oct. 20, 2005

Related U.S. Application Data

(63) Continuation of application No. 10/338,130, filed on Jan. 6, 2003, now Pat. No. 6,783,262.

(51) Int. Cl.
*F21V 7/00* (2006.01)

(52) U.S. Cl. ..... 362/346; 362/147; 362/302

(58) Field of Classification Search ..... 362/346
See application file for complete search history.

(56) References Cited

U.S. PATENT DOCUMENTS 1,946,465 A 2/1934 Arras
3,389,246 A * 6/1968 Shemitz ..... 362/147
3,662,165 A 5/1972 Osteen et al.
3,944,810 A 3/1976 Grindle
4,303,971 A 12/1981 Hogue et al.
4,472,767 A * 9/1984 Wenman ..... 362/302
5,014,175 A * 5/1991 Osteen et al. ..... 362/348
6,062,710 A 5/2000 Hewitt
6,417,919 B1 7/2002 Hewitt et al.
6,783,262 B2 * 8/2004 Orfield et al. ..... 362/346

* cited by examiner

*Primary Examiner*—Sandra O'Shea
*Assistant Examiner*—Anabel Ton
(74) *Attorney, Agent, or Firm*—Merchant & Gould P.C.

(57) ABSTRACT

A light fixture is described. The light fixture includes a socket housing and a reflector housing. The socket housing includes a socket for receipt of a lamp, and a reflector housing mounting surface. The reflector housing includes a direct reflector for providing direct light onto a target lighting area and an indirect reflector for providing indirect light onto the target lighting area. The direct reflector includes a direct reflector first end, a direct reflector second end, and a direct reflector body extended between the first end and the second end. The direct reflector body extends sufficiently far to provide a cut off angle between a lamp provided in the socket and the direct reflector second end of less than about 50°. The indirect reflector extends from the direct reflector around a circumference of the direct reflector in an amount sufficient to shield a lamp provided in the socket. A facility having a plurality of ceiling mounted light fixtures, and a reflector housing are described.

19 Claims, 5 Drawing Sheets

LIGHT FIXTURE, REFLECTOR HOUSING, AND FACILITY THAT INCLUDES A PLURALITY OF LIGHT FIXTURES

This application is a continuation of application Ser. No. 10/338,130, filed on Jan. 6, 2003 which issued as U.S. Pat. No. 6,783,262 on Aug. 31, 2004, which application is incorporated herein by reference.

FIELD OF THE INVENTION

The invention relates to a light fixture, a reflector housing for use as part of a light fixture, and a facility that includes a plurality of light fixtures. The reflector housing, when mounted about a lamp or bulb, provides direct and indirect lighting and reduces glare.

BACKGROUND OF THE INVENTION

Lighting is often provided in facilities, such as factories and warehouses, in a manner that minimizes energy output and minimizes the number of light fixtures needed to provide the desired level of illumination. As a result, facilities are often designed to include a minimum number of light fixtures that spread the light or provide a wide throw of the light to create an even distribution of light. Light fixtures that are commonly used in industrial settings are available from, for example, Day-Brite Lighting.

Several light fixtures are designed to hang from a ceiling and provide both down lighting and up lighting. In the context of ceiling mounted fixtures, down lighting is referred to as direct lighting, and up lighting is referred to as indirect lighting. Patents that describe exemplary lighting fixtures include U.S. Pat. No. 4,472,767 to Wenman; U.S. Pat. No. 5,014,175 to Osteen et al.; U.S. Pat. No. 3,662,165 to Osteen et al.; and U.S. Pat. No. 1,946,465 to Arras.

In general, a well-lit environment can be considered one where there is sufficient light on a work surface to provide contrast and there is nothing significantly brighter or darker than the work surface in a person's field of view. The existence of glare can cause a decrease in worker productivity by obscuring detail and generally decreasing visibility. By decreasing visibility, eyes become tired, tasks requiring vision become more difficult to complete, and defects become less apparent.

SUMMARY OF THE INVENTION

A light fixture is provided according to the invention. The light fixture includes a socket housing and a reflector housing. The socket housing includes a socket for receipt of a lamp, and a reflector housing mounting surface. The reflector housing includes a direct reflector for providing direct light onto a target lighting area and an indirect reflector for providing indirect light onto the target lighting area. The direct reflector includes a direct reflector first end, a direct reflector second end, and a direct reflector body extended between the first end and the second end. The direct reflector body extends sufficiently far to provide a cut off angle between a lamp provided in the socket and the direct reflector second end of less than about 50°. The indirect reflector extends from the direct reflector around a circumference of the direct reflector in an amount sufficient to shield a lamp provided in the socket.

A facility having a plurality of ceiling mounted light fixtures is provided according to the invention. In addition, a reflector housing is provided according to the invention.

DETAILED DESCRIPTION OF THE INVENTION

Light fixtures according to the invention provide both direct lighting and indirect lighting. In general, direct lighting refers to the light that flows directly from a light source onto a work surface. Indirect lighting refers to the light reflected from another surface, such as a wall or a ceiling. By providing direct lighting and indirect lighting, it is believed that visual comfort can be enhanced. As a result, there is an increased level of visibility of a task area in an environment that has both direct lighting and indirect lighting.

In order to provide lighting to relatively large facilities, it is often necessary to have several light fixtures provided throughout the facility. For example, there may be a row of light fixtures suspended from a ceiling. In a facility having a large number of light fixtures, it is expected that many of the light fixtures, in particular those that are far away, do not contribute much lighting that illuminates the task area for an individual worker. Those lights, however, can decrease the visibility of a task area for an individual worker if those lights are within the worker's field-of-view and provide a source of light that greatly contrasts with the task area. That is, light fixtures that may be quite far away from a worker and that are not being relied upon by that worker to illuminate his task area may, in fact, decrease the visibility of the task area by creating glare.

At least two types of glare are often encountered in a facility. One kind of glare is disability glare. Disability glare is caused by a light source being in the field-of-view of an individual. Disability glare can often be referred to as discomfort glare. The second kind of glare is veiling glare. In general, veiling glare results from reflections that are superimposed upon a visual task.

The lighting fixture and the reflector housing according to the invention are part of an on-going effort by Orfield Laboratories, Inc., the Assignee of this patent application, to develop lighting systems that enhance visual task performance. Prior efforts at enhancing visual task performance are described in U.S. Pat. No. 6,417,919 to Hewitt et al. The entire disclosure of U.S. Pat. No. 6,417,919 is incorporated herein by reference.

Figure 1:
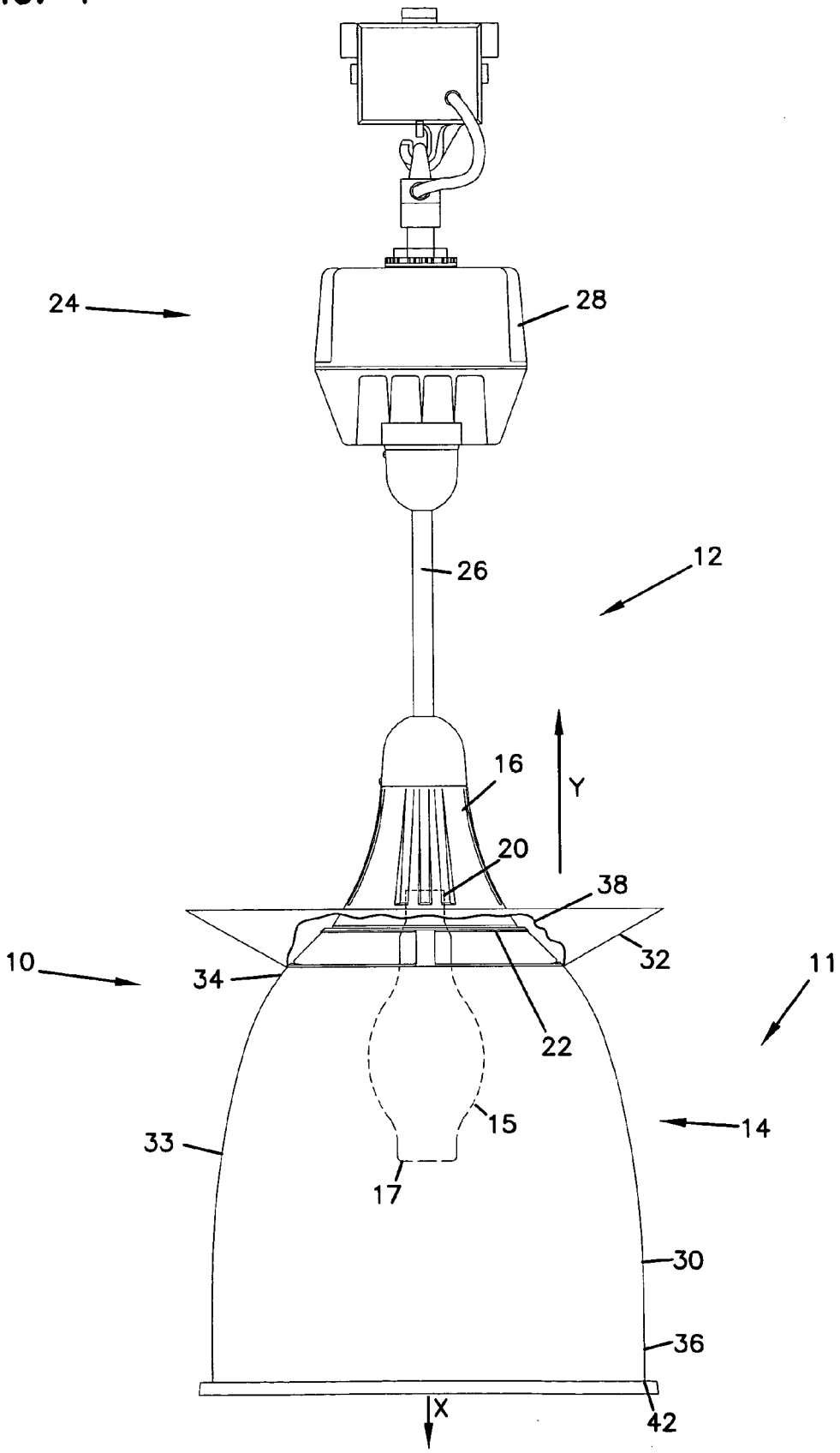
FIG. 1 is a side view of a light fixture according to the principles of the present invention.
Figure 2:
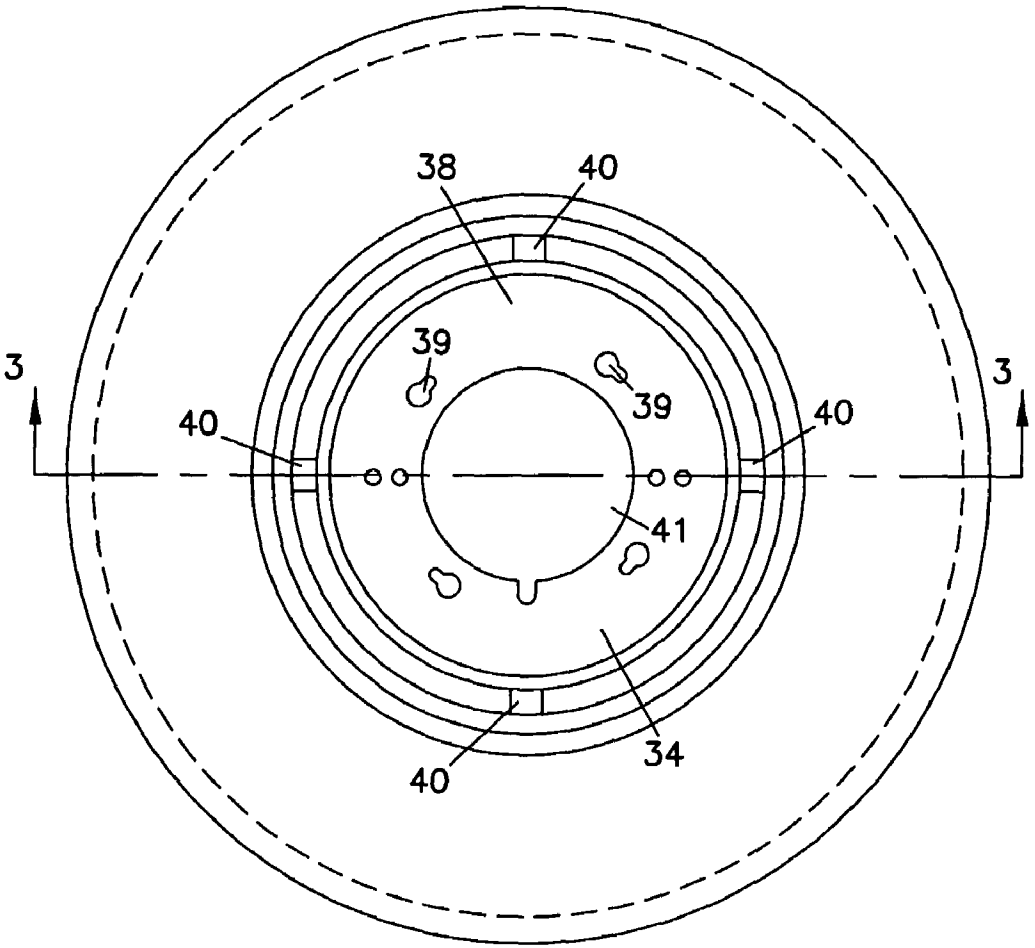
FIG. 2 is a top view of the reflector housing of the lighting fixture of FIG. 1.
Figure 3:
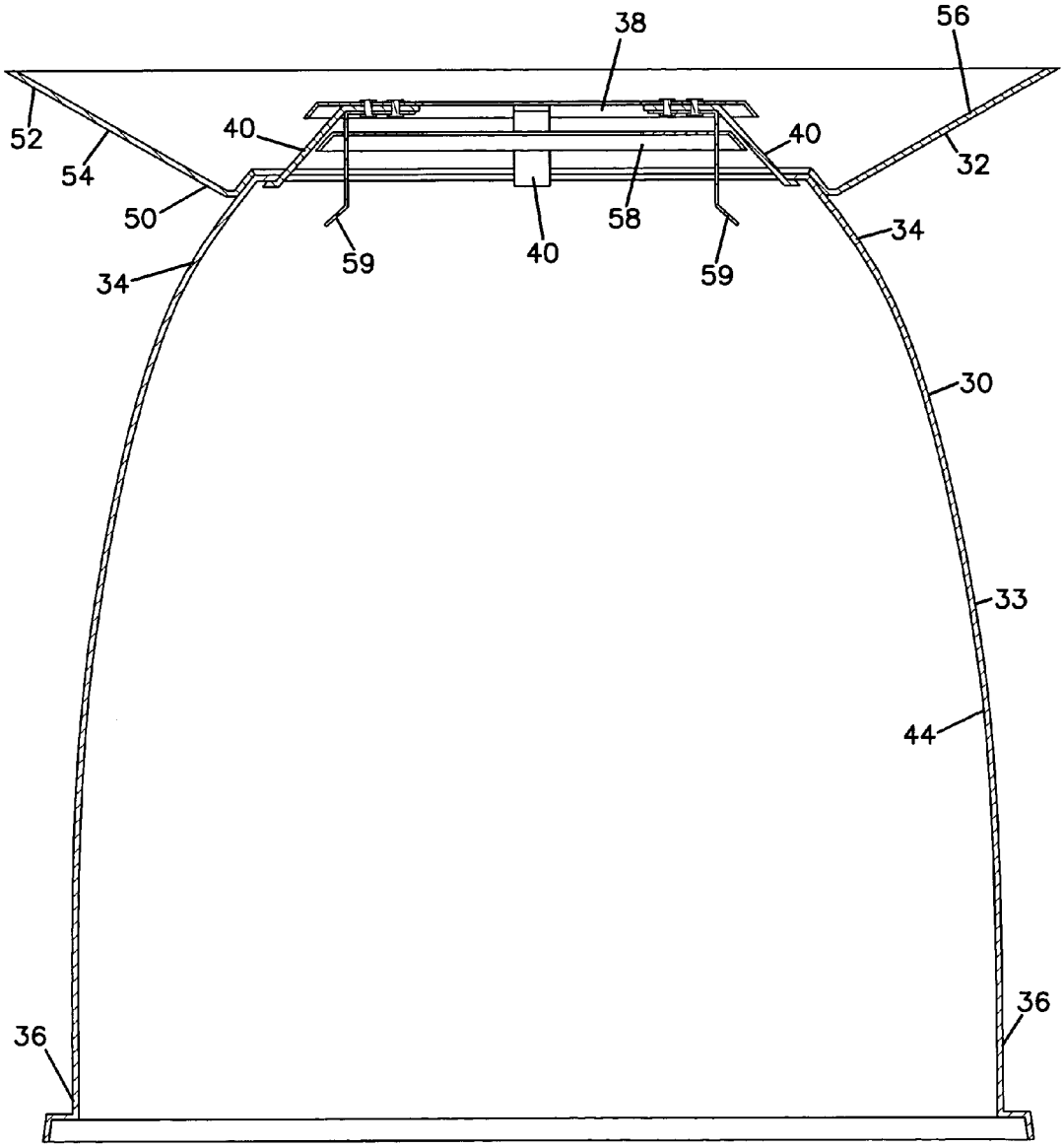
FIG. 3 is a sectional view of the reflector housing of FIG. 2 taken along line 3-3.

Now referring to FIGS. 1-3, a light fixture according to the invention is shown at reference numeral 10. The light fixture 10 can be referred to as a ceiling mounted light 11 because it is designed to hang from a ceiling or some other structure and remain suspended above workers or individuals in need of lighting. The light fixture 10 can be characterized as a direct/indirect light fixture because a portion of the light from the fixture provides direct lighting as shown by the arrow labeled x, and a portion of the light from the device provides indirect lighting as shown by the arrow labeled y. The light directed downward onto a task area can be referred to as direct lighting, and the light directed upward to illuminate the ceiling of a facility can be referred to as indirect lighting. By providing both direct and indirect lighting, it is expected that the visual balance in the field of view and visual comfort will be enhanced.

The facility that can be illuminated by the light fixture 10 (or a plurality of light fixtures) can be any industrial, commercial, or residential facility. It is expected that the light fixture will be particularly useful in industrial facilities including warehouses and factories, and that a plurality of light fixtures will be arranged in a row.

The light fixture 10 provides direct lighting to a target lighting area. In general, the target lighting area refers to the area of a facility that is intended to be directly lit by the light fixture. In a facility that includes a series of light fixtures, each light fixture provides direct lighting to its own target lighting area. In the case of a light fixture that hangs from a ceiling, the target lighting area is generally provided below the lighting device. It is possible that light fixtures may have target lighting areas that overlap. In fact, overlap is likely in order to reduce the possibility of dark places between target lighting areas. In general, it is expected that the overlap can be up to about 50% and can be between about 20% and about 40%. In the case of a facility having a series of lighting devices hanging from a ceiling, it is expected that a lighting fixture that is far away (measured horizontally) from a task area does not appreciably influence the light level on that task area in comparison with lighting fixtures that are much closer or directly overhead.

The light fixture 10 includes a holder 12 and a direct/indirect reflector housing 14. The holder 12 is generally the structure that supports the lamp or bulb 15 and the reflector housing and allows current to flow therethrough to power the lamp. The direct/indirect reflector housing 14 reflects light from the lamp or bulb 15 to provide both direct lighting and indirect lighting. The direct/indirect reflector housing 14 can be referred to as the reflector housing.

The holder 12 can be provided for powering the lamp or bulb 15 and supporting the reflector housing 14. The holder 12 can include a socket housing 16 that includes a socket 20 for holding the lamp 15 in place and a reflector mounting structure 22 for attaching the reflector housing 14 to the socket housing 16. The holder 12 can include a mounting device 24 for attaching the socket housing 16 to another surface such as a ceiling or a beam. In the case of the ceiling mounted light fixture 11, the mounting device 24 can include a stem 26 that allows for adjustment of the height of the lamp above the task area to be illuminated. The length of the stem 26 depends, at least in part, on the height of the ceiling of the facility above the floor. In many applications, it is expected that the stem 26 will have a distance of at least about 24 inches. Electric wires can extend through the stem 26 to power the lamp. A ballast housing 28 can be provided when the lamp requires a ballast as is common in the industry. The ballast housing 28 can be provided a distance away from the lamp as shown in FIG. 1 in order to reduce the shading effect the ballast housing 28 may have on the ceiling as a result of upward lighting. That is, the stem 26 can be provided between the socket housing 16 and the ballast housing 28 to separate the reflector housing 14 from the ballast housing 28.

The lamp or bulb can be any light source powered by electrical energy including light sources not yet developed. Exemplary light sources include high intensity discharge (HID) lamp, such as a sodium vapor, mercury vapor, or metal halide lamp. Additional light source include incandescent and quartz sources. Exemplary HID lamps that can be used include standard size HID lamps and compact HID lamps. HID lamps are commonly available as 400 watt and less such as 250 watt. The lamp can be coated or noncoated. An exemplary coating can be referred to as a frosted coating. By providing lighting fixtures according to the invention that control the direct light to a target lighting area resulting from a cut-off angle of less than about 50°, it is possible to use more light fixtures at a lower watt output to help decrease the existence of glare in a facility.

The socket housing 16 and the socket 20 can be constructed so that the socket 20 can move between several positions relative to the socket housing 16. That is, the socket housing may have an adjustable socket that allows the socket to move deeper or shallower in the reflector housing 14. One technique for controlling the percentage of light that is used for direct lighting versus indirect lighting is to adjust the placement of the socket relative to the socket housing. By placing more of the lamp deeper into the reflector housing 14, it is expected that more light will be provided for indirect lighting. By moving the lamp outward in the reflector housing 14, it is expected that more light will be provided for direct lighting.

The reflector housing 14 includes a direct reflector 30 and an indirect reflector 32. Both the direct reflector 30 and the indirect reflector 32 encircle the lamp 15. The direct reflector 30 includes a direct reflector body 33 that extends between a direct reflector first end 34 and a direct reflector second end 36. The first end 34 can be provided for attachment to the socket housing 16. As shown in FIGS. 1-3, the first end 34 includes a mounting bracket 38 that engages the mounting structure 22 on the socket housing 16. The mounting bracket 38 can be attached to the remainder of the reflector housing 14 by tabs 40. Alternatively, the mounting bracket may be formed as part of the same material that forms the first end 34. The mounting bracket 38 can include screw holes 39 for attaching the mounting bracket 38 to the mounting structure 22. In addition, the mounting bracket 38 includes a lamp opening 41 through which the lamp 15 can extend. The second end 36 extends away from the lamp or bulb by an amount sufficient to provide a cut-off angle between the lamp or bulb and the second end 36 of less than about 500. The cut-off angle refers to the angle between an axis extending from a nadir of the lamp or bulb 15 and an axis extending from the exterior of the lamp 17 to the outermost edge 42 of the second end 36. As the cut-off angle decreases, the target lighting area decreases, for a given height above a floor and a given lamp design. A light fixture having a large cut-off angle throws a wide pattern of direct light. Stated differently, for generally consistent lighting fixture designs, a smaller cut off angle results in a direct reflector that extends farther below the bottom surface of the lamp compared with a light fixture having a greater cut off angle. The direct reflector can be designed to have a cut off angle of less than about 45°, less than about 40°, less than about 35°, or less than about 30°. In most applications, it is expected that the cut off angle will be between about 30° and about 50°, and may be between about 35° and about 45°. It should be understood that the cut off angle may depend on the height at which the lighting device is intended to be used. Lower cut off angles may be more appropriate at higher heights and higher cut off angles may be more appropriate at lower heights from the floor. In most applications, it is expected that the lighting device will be provided at a height of between about 20 feet and about 40 feet, and may be provided at a height of between about 25 feet and about 35 feet, wherein the height is measured from the bottom of the lighting fixture to the floor.

The direct reflector 30 includes a direct reflector body 33 having an interior surface 44. It is generally desirable to provide the interior surface 44 with a shape and a gloss or specularity sufficient to reduce brightness apparent to someone viewing the light fixture 10 from a position outside the target lighting area. It is desirable for someone looking at the interior surface 44 from outside the target lighting area not to notice a significantly bright spot resulting from the reflectance of the lamp or bulb. The interior surface can be sufficiently curved and sufficiently polished so that light reflected by the interior surface 44 is directed to an area generally corresponding to the target lighting area. The interior surface 44 can be curved as shown in FIG. 2. Alternatively, the curve can be provided in steps if it is desired to reduce the cost of manufacturing the direct reflector 30. It is expected that a curved interior surface will be more efficient than a stepped interior surface for reducing glare. By sufficiently polishing the interior surface 44, it is expected that there will be less scattering or diffusion of light from the interior surface 44 thereby reducing the occurrence of bright spots.

An advantage of the light fixture 10 is that the occurrence of bright spots in an individual's field of view can be reduced. For example, a worker in an industrial setting may have a series of lights above his head extending off into a distance. The lights immediately above the person are not in the person's field of view when the person is viewing in a horizontal direction. The lights farther away may tend to come into the person's field of view. By reducing the bright spots created by light fixtures relatively far away from a worker, glare can be reduced compared with other lighting fixtures that produce bright spots.

The finish of the interior surface 44 can be sufficiently glossy that it acts to reduce glare. A spun finish may have a gloss that is sufficient to reduce glare. It is expected that the reduction of glare can be enhanced by providing a further polished or glossy finish. A spun finish can have a gloss value of about 175 as measured by a 60° gloss value meter. In certain desired applications, the interior surface 44 can have a gloss value of at least about 180 as measured by a 60° gloss value meter, and can be greater than about 200°. Preferably, the interior surface 44 resembles a mirror.

The direct reflector 30 can be provided from a material that provides a desired level of gloss or specularity to the interior surface 44. An exemplary material includes aluminum. The surface of the aluminum can be polished to provide the desired gloss. In general, an aluminum finish that has been spun, without polishing, may have insufficient gloss or specularity.

The indirect reflector 32 extends about the lamp or bulb to shield the lamp or bulb from a viewer located outside the target lighting area and to direct light in the direction of the arrow y. In the case of a ceiling mounted light fixture 11, the direction y is toward the ceiling. In general, it is expected that the neck of the lamp would be visible from a viewer located outside the target lighting area in the absence of the indirect reflector 32. For example, when viewed from the floor, with the lighting device 11 at 20 feet or more above the floor, the indirect reflector 32 should eliminate the glare coming out the direct reflector first end 34. In order to shield the neck of the lamp, the indirect reflector 32 extends from the direct reflector 30 and extends around the circumference of the direct reflector 30.

The indirect reflector 32 includes an indirect reflector first end 50 and an indirect reflector second end 52 and an indirect reflector body 54. The body should have a sufficient length and extend away from the direct reflector 30 at an angle sufficient so that a person viewing the lighting device from the floor, wherein the fixture is at a height of at least 20 feet, will not see the lamp or bulb that provides for indirect lighting. The body 54 does not need to be curved and can be provided with a conical shape. In addition, the interior surface 56 need not be highly polished or specular. The interior surface 56 can be provided as a spun finish. The indirect reflector first end 50 can be attached to the direct reflector first end 34. The attachment may be made by welding.

The reflector housing 14 can include a direct light/indirect light deflector 58 that can be adjusted along the adjuster brackets 59. The adjuster brackets 59 are shown extending from the mounting bracket 38. In general, the direct light/indirect light deflector 58 encircles the lamp and tends to divide the light coming out of the lamp between indirect light and direct light. In addition, the direct light/indirect light deflector 58 can be provided so that it moves to adjust the ratio of light distributed between direct light and indirect light. It should be understood that the direct light/indirect light deflector 58 is an optional feature of the reflector housing 14.

The lighting fixture 10 can be constructed so that it is suspended from a ceiling by an amount sufficient to increase the illumination of the ceiling by indirect lighting. In general, it is desirable to have the lighting device sufficiently above a worker so that the lighting device is not in the worker's field-of-view. In addition, it is desirable to lower the lighting device from the ceiling in order to sufficiently illuminate the ceiling by indirect lighting. The components of the holder 12, including the ballast housing 28, can be provided with a white coating, such as, a matte white paint surface, to reduce reflection of light therefrom.

Figure 4:
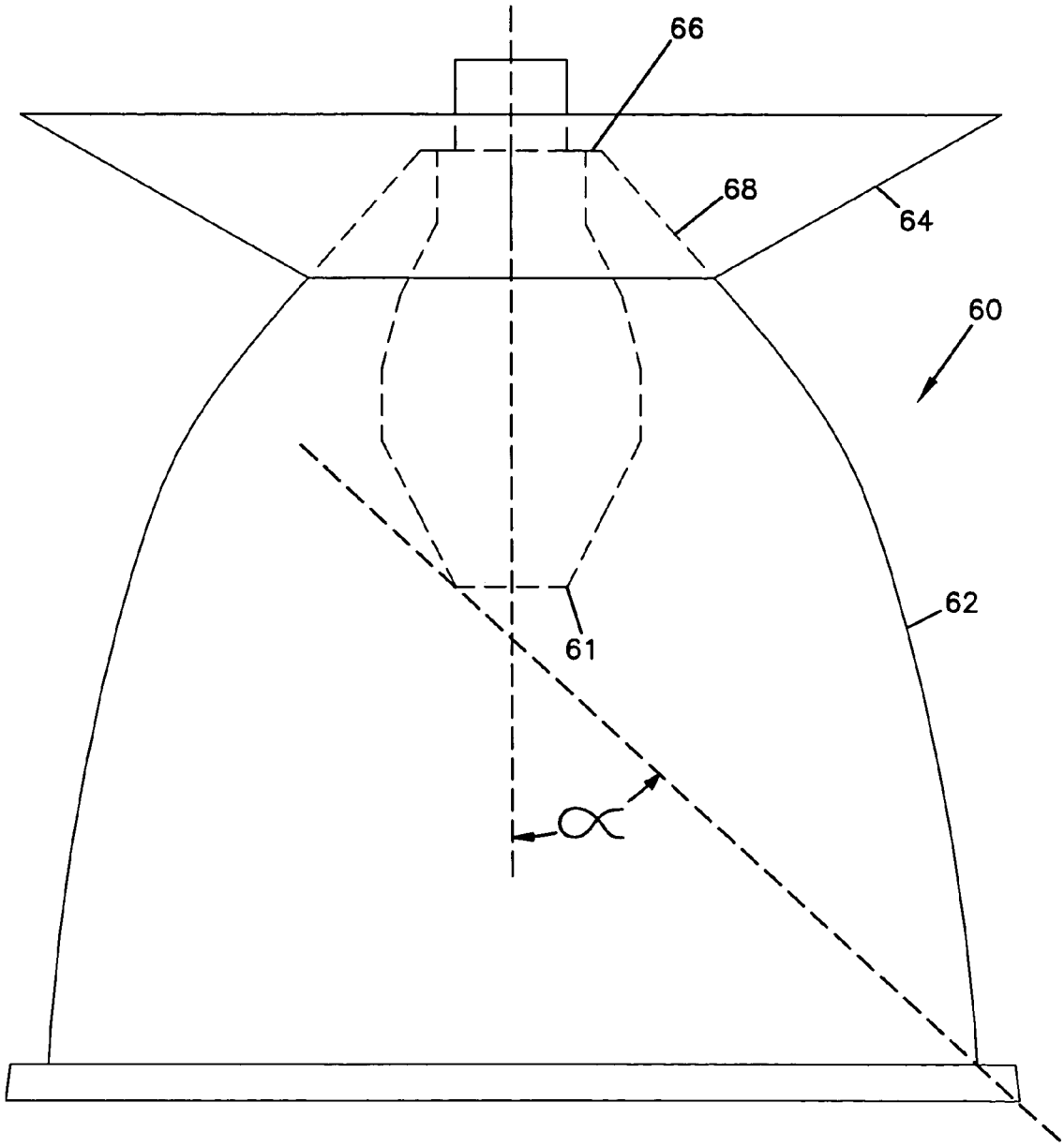
FIG. 4 is a side view of an alternative embodiment of a reflector housing according to the principles of the present invention.
Figure 5:
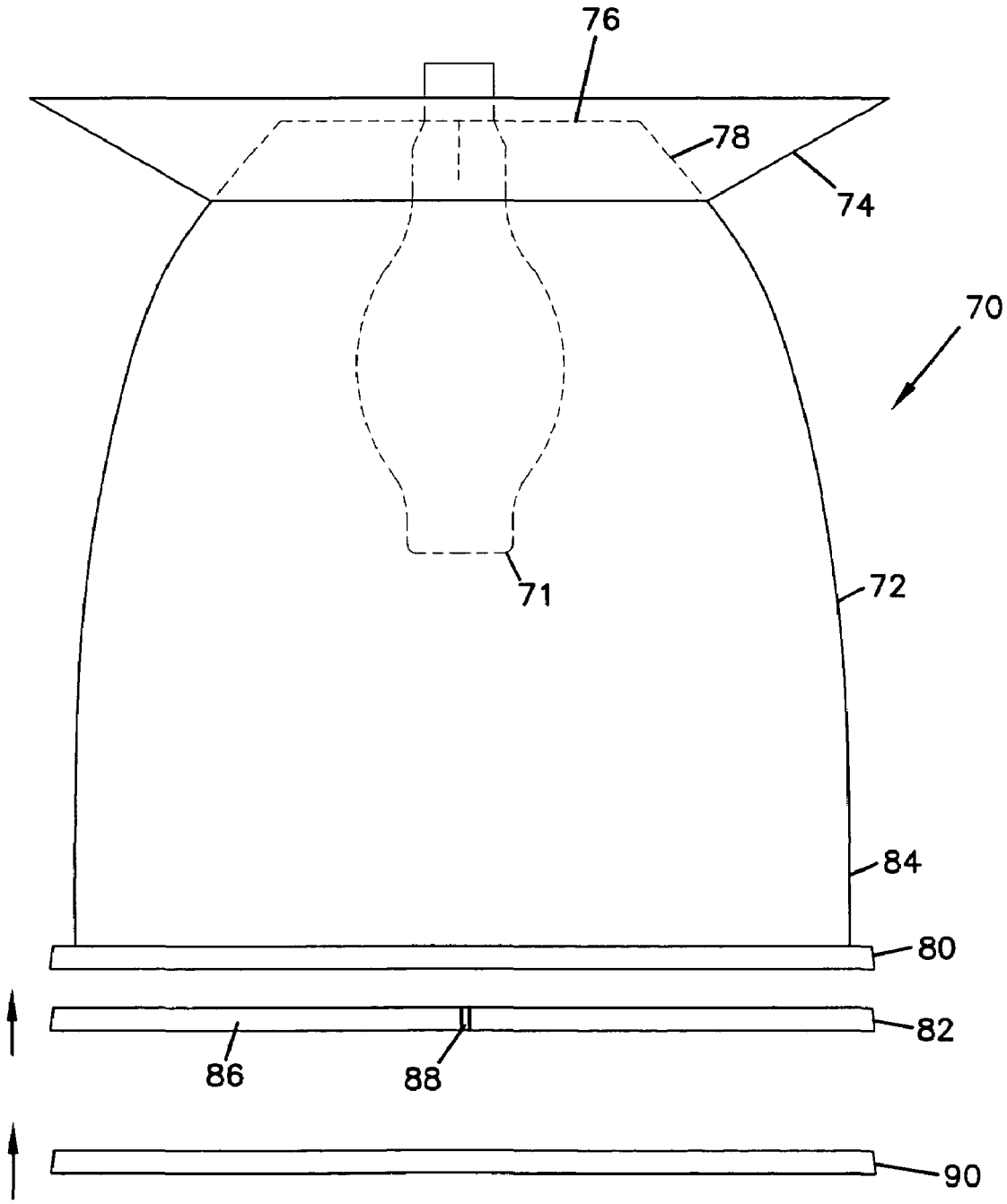
FIG. 5 is a side view of an alternative embodiment of a reflector housing according to the principles of the present invention.

Now referring to FIGS. 4-5, alternative reflector housings are shown at reference numerals 60 and 70. The reflector housings 60 and 70 are provided with different configurations to show how the reflector housing design can vary depending upon the configuration and size of the bulbs 61 and 71. Both reflector housings 60 and 70 provide about the same cut off angle which is about 45°. The cut off angle is shown by the symbol alpha in FIG. 4. It is expected that both reflector housings 60 and 70 have a configuration that directs light or focuses the light to a target lighting area and, as a result, reduces glare compared with many prior art luminaires.

Both reflector housings 60 and 70 include a direct reflector 62 and 72 and an indirect reflector 64 and 74. Lamps 61 and 71 are placed within the housings for illustration. In both reflector housings, the mounting brackets 66 and 76 can be provided as an extension of the direct reflectors 62 and 72. Openings can be provided within the mounting brackets 66 and 76 and/or the direct reflector first ends 68 and 78 to allow light to escape for upward or indirect lighting.

As shown in FIG. 5, the direct reflector housing 72 can include a rim 80 for holding a lens. The lens may enclose the direct reflector 72. Similarly, a generally transparent material or cover such as plastic may be placed over the openings in the direct reflector first end 78 to enclose the direct reflector 72. In certain situations it may be desirable to enclose the lamp 71. Although this feature is described in the context of the reflector housing shown in FIG. 5, it can be applied to the previously described reflector housings. Similarly, a louver design 82 can be provided to fit in the rim 80 or in the direct reflector second 84. The louver 82 includes a first cross member 86 and a second cross member 88. In general, the cross members 86 and 88 may be prepared from sheet metal and are provided to help reduce or decrease the cut off angle and/or to help reduce glare or bright spots. In the case of a louver design having two cross members, the cross members can be provided with a depth of about 3 inches to about 4 inches. When the louver design is provided as an egg crate design, the cross members can be provided with openings of about 1 inch to 2 inches square and provided with a depth of between about 1 inch and about 2 inches. In addition, deflectors 90 can be provided in the rim 80 or the direct reflector second end 84 to help reduce bright spots caused by the lamp 71.

The light fixture according to the invention can be used to help enhance visual task performance. Visual task performance can be improved or enhanced in a facility by creating a lighting environment that improves contrast on a work surface and reduces glare. In general, the term "visual task performance" as used herein, refers to the performance of a task that is conducted in view of visual input. Exemplary tasks include reading, performing a step on an object, and viewing a defect on an object.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A light fixture comprising:

(a) a socket comprising a light source powered by electrical energy;

(b) a reflector housing comprising a direct reflector for providing direct light onto a target lighting area and an indirect reflector for providing indirect light onto the target lighting area, wherein the direct reflector comprises:

(i) a direct reflector first end;

(ii) a direct reflector second end; and (iii) a direct reflector body extending between the first end and the second end by an amount sufficient to provide a cat off angle between a nadir of the light source and the direct reflector second end of less than about 50°; and (c) the indirect reflector extending from the direct reflector around a circumference of the direct reflector to shield the light source powered by electrical energy.

2. A light fixture according to claim 1, wherein the light source comprises a high intensity discharge lamp.

3. A light fixture according to claim 2, wherein the high intensity discharge lamp comprises a sodium vapor lamp, a mercury vapor lamp, or a metal halide lamp.

4. A light fixture according to claim 1, wherein the light source comprises an incandescent light source.

5. A light fixture according to claim 1, wherein the light source comprises a quartz light source.

6. A light fixture according to claim 1, wherein the cutoff angle is less than about 45°.

7. A light fixture according to claim 1, wherein the cutoff angle is less than about 40°.

8. A light fixture according to claim 1, wherein the cutoff angle is less than about 35°.

9. A light fixture according to claim 1, wherein the cutoff angle is less than about 30°.

10. A light fixture according to claim 1, wherein the direct reflector comprises an interior surface polished to a gloss value of at least about 180 according to a 60° gloss value meter.

11. A light fixture according to claim 1, wherein the second end of the reflector comprises a rim and a lens provided in the rim for enclosing the direct reflector.

12. A light fixture according to claim 1, wherein the direct reflector first end comprises a bracket for attaching the reflector housing to the socket.

13. A light fixture according to claim 1, wherein the light source comprises a coated light source.

14. A light fixture according to claim 13, wherein the coating comprises a frosted coating.

15. A facility having a plurality of ceiling mounted light fixtures, wherein each of the light fixtures comprises:

(a) a socket housing comprising a light source powered by electrical energy;

(b) a reflector housing comprising a direct reflector for providing direct light onto a target lighting area and an indirect reflector for providing indirect light onto the target lighting area, wherein the direct reflector comprises:

(i) a direct reflector first end;

(ii) a direct reflector second end; and (iii) a direct reflector body extending between the first end and the second end by an amount sufficient to provide a cut off angle between a nadir of the light source and the direct reflector second end of less than about 50°; and (c) the indirect reflector extending from the direct reflector around a circumference of the direct reflector to shield the light source powered by electrical energy.

16. A facility according to claim 15, wherein the plurality of ceiling mounted light fixtures arc arranged to provide a target lighting area overlap, for at least two of the ceiling mounted light fixtures of up to about 50%.

17. A facility according to claim 15, wherein the plurality of ceiling mounted light fixtures are arranged to provide a target lighting area overlap, for at least two of the ceiling mounted light fixtures of up to about 20% to about 40%.

18. A facility according to claim 15, wherein the high intensity discharge lamp comprises a sodium vapor lamp, a mercury vapor lamp, or a metal halide lamp.

19. A facility according to claim 15, wherein the light source comprises a quartz light source.

* * * * *

UNITED STATES PATENT AND TRADEMARK OFFICE

CERTIFICATE OF CORRECTION

PATENT NO. : 7,252,413 B2
APPLICATION NO. : 10/931264
DATED : August 7, 2007
INVENTOR(S) : Orfield et al.

It is certified that error appears in the above-identified patent and that said Letters Patent is hereby corrected as shown below:

Col. 4, line 41: "than about 500." should read --than about 50°.--

Col. 7, line 39, claim 1: "provide a cat off angle" should read --provide a cut off angle--

Signed and Sealed this

Twenty-seventh Day of November, 2007

JON W. DUDAS
*Director of the United States Patent and Trademark Office*